US005094402A

United States Patent [19]

Perret, Jr. et al.

[11] Patent Number: 5,094,402

[45] Date of Patent: Mar. 10, 1992

[54] HIGH PERFORMANCE SPRAY HEAD

[76] Inventors: Robert J. Perret, Jr., 2163 Pacific Ave., Costa Mesa, Calif. 92627; Jerry E. Thompson, 6350 E. Camino Grande, Anaheim, Calif. 92807; Paul L. Zimmerman, 12801 Rosecrans, Norwalk, Calif. 90650

[21] Appl. No.: 597,004

[22] Filed: Jan. 15, 1990

[51] Int. Cl.[5] ..... B05B 1/34

[52] U.S. Cl. ..... 239/526; 239/396; 239/583; 239/600; 239/DIG. 19

[58] Field of Search ..... 239/525, 526, 583, 600, 239/DIG. 19, 390, 396

[56] References Cited

U.S. PATENT DOCUMENTS

| | | | |
|---|---|---|---|
| 1,503,001 | 7/1924 | Murray | 239/596 X |
| 1,536,352 | 5/1925 | Murray | 239/583 X |
| 1,553,709 | 9/1925 | Murray | 239/526 X |
| 3,000,576 | 9/1961 | Levey et al. | 239/583 X |
| 3,190,564 | 6/1965 | Liedberg | 239/583 X |
| 3,670,967 | 6/1972 | Fahlin et al. | 239/525 X |
| 4,567,954 | 2/1986 | Voight, III et al. | 239/600 X |

*Primary Examiner*—Andres Kashnikow

*Attorney, Agent, or Firm*—Plante Strauss & Vanderburgh

[57] ABSTRACT

There is disclosed a spray head for an airless spray gun. The spray head has a tubular housing for removable attachment to the discharge end of an otherwise conventional airless spray gun, adjacent the valve member of the spray gun. The housing is counterbored to form an inner annular shoulder and contains a removable plug that is slidably received within the housing. The annular shoulder is stop for the plug which is retained in the housing at the preselected location by a retainer member that is removably threaded into the discharge end of the housing. The plug has, on its upstream end, a valve seat to engage the valve member of the spray gun and, on its downstream end, a discharge orifice formed by divergent angular bores which intersect a through bore of the plug. Preferably the plug also supports, on its downstream face, a diffuser baffle that extends transversely across and slightly axially spaced from the discharge face of the orifice which is supported by a pair of diametrically located, axial prongs that support the baffle.

32 Claims, 3 Drawing Sheets

HIGH PERFORMANCE SPRAY HEAD

BACKGROUND OF THE INVENTION

1. Field of Invention

This invention relates to a spray head for high pressure airless spraying and, in particular, to a spray head capable of handling very highly loaded suspensions and mastic compositions as well as low viscosity liquids.

2. Brief Statement of the Prior Art

Airless spraying of liquids is widely practiced, particularly for professional spray applications of paints, lacquers and the like. Typically, these liquids are sprayed under pressures of from 500 to 3,500 psi through minute orifices of highly wear-resistent material such as tungsten carbide.

A difficulty commonly experienced is the clogging of the spray tips with solids and this problem becomes particularly acute when attempting to spray liquids which are highly loaded with solids, such as mastic compositions. Typical of such compositions are fireproofing compositions, water-proofing coating compositions, and asbestos encapsulating coating compositions. These compositions can have as high as 85 weight percent solids. The solids are frequently very abrasive, e.g. clays, silica, sand and the like. Difficulty is experienced when spraying such highly loaded compositions with airless spraying equipment because of the highly erosive character of the compositions and because the solids clog the orifices commonly used in airless spray equipment.

It is desirable to provide a spray head useful in an airless spray gun that would handle the highly viscous and erosive compositions while not compromising the ability of the spray head to spray low viscosity liquids such as stains, lacquers, sealers alkyl enamels, and water-base paints and enamels.

OBJECTS OF THE INVENTION

It is an object of this invention to provide a spray head useful in an airless spray gun which has a wide range of capability for handling low viscosity to high viscosity liquids.

It is also an object of this invention to provide a head for an airless spray gun which is capable of handling mastic compositions containing high contents of solids.

It is an additional object of this invention to provide a spray head for airless spraying capable of handling low viscosity liquids at pressures up to 5,000 psi.

It is a further object of this invention to provide a spray head for airless spraying having readily replaceable valve members and readily replaceable orifice members.

It also a further object of the invention to provide a spray head for an airless spray gun which is provided with a diffuser baffle to insure thorough diffusion of the compositions discharged from the spray head.

BRIEF DESCRIPTION OF THE INVENTION

This invention is a spray head useful with an airless spray gun. The spray head is contained in a generally tubular housing adapted for removable attachment to the discharge end of an otherwise conventional airless spray gun, adjacent the valve member of the spray gun. The housing contains a removable plug that is slidably received within the housing and that has, on its upstream end, a valve seat to engage the valve member of the spray gun and, on its downstream end, a discharge orifice formed by divergent angular bores which intersect a through bore of the plug. Preferably the plug also supports, on its downstream face, a diffuser baffle that extends transversely across and slightly axially spaced from the discharge face of the orifice. For this purpose, the downstream face of the plug can have a pair of diametrically located, axial prongs that support the baffle.

The housing is counterbored to form an inner annular shoulder that serves as a stop for the plug and the plug is retained in the housing at the preselected location by a retainer member that is removably threaded into the discharge end of the housing. Preferably the valve member which is used with the valve head of the invention has a conically tapered forward end which seats in a conical valve seat carried by the plug member.

BRIEF DESCRIPTION OF THE DRAWINGS

The invention will be described with reference to the figures of which.

DESCRIPTION OF PREFERRED EMBODIMENT

Figure 1:
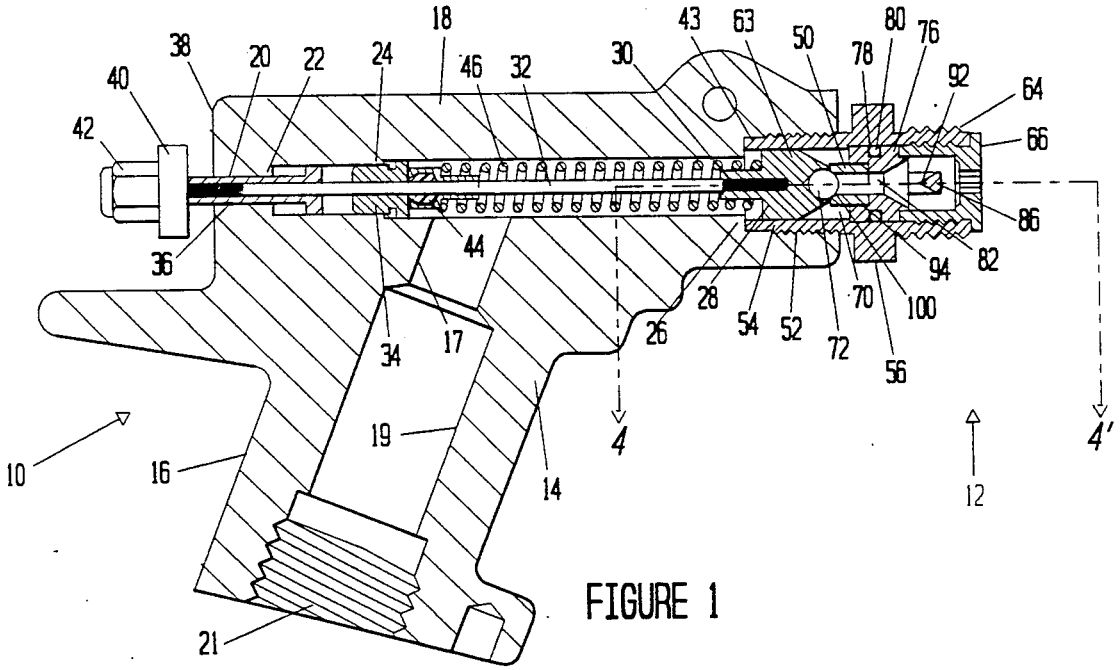
FIG. 1 is a sectional view of a spray gun with the spray head of the invention.
Figure 2:
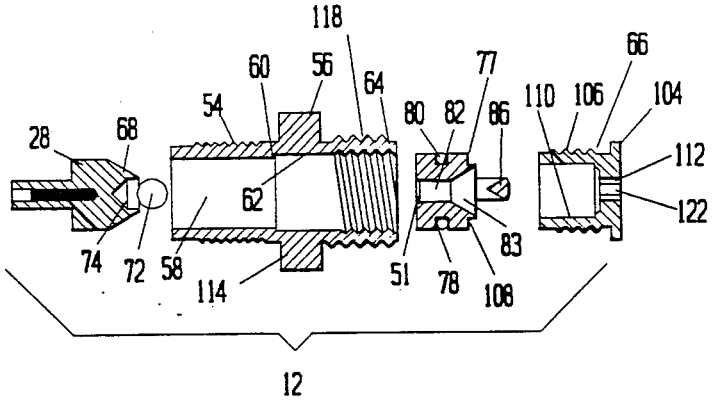
FIG. 2 is an exploded and enlarged sectional view of the spray head of the invention.
Figure 3:
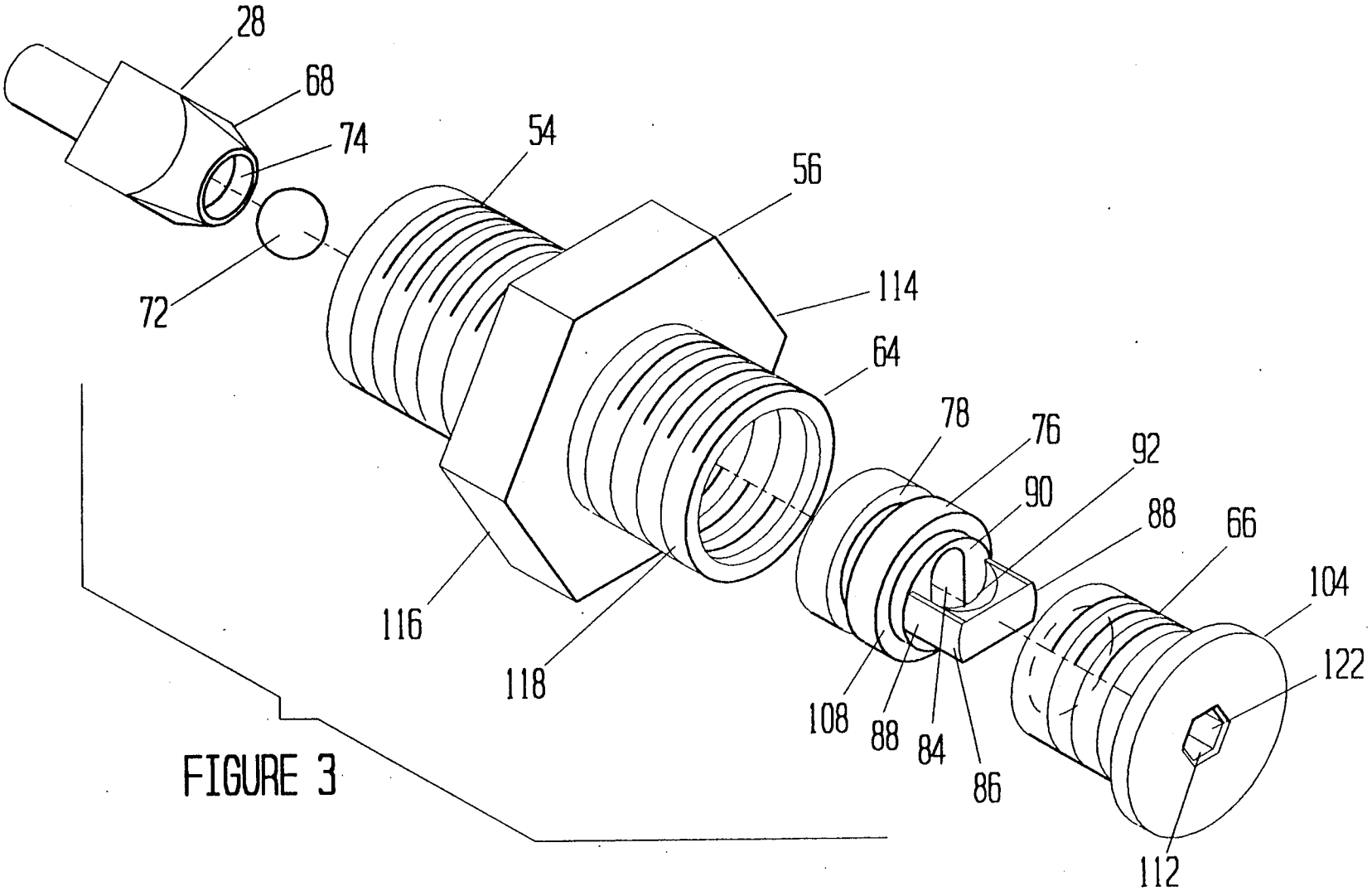
FIG. 3 is an exploded perspective view of the spray head of the invention.

FIG. 1 is a sectional view of an airless spray gun 10 which is fitted with the spray head 12 of the invention. The spray head 12 is also shown in exploded sectional view in FIG. 2 and in exploded perspective view in FIG. 3, however, FIGS. 2 and 3 show a spray head with a slightly modified valve seat, as described in detail hereinafter. As illustrated in FIG. 1, the gun 10 has a forged or cast housing 14 which has a pistol grip 16 and a main housing 18. The pistol grip 16 has a through bore 17 which is counterbored at 19 to receive a tubular particulate filter (not shown), and counterbored and internally threaded at 21 for attachment of a swivel hose adapter for connection of a flexible hose that supplies the liquid under pressure to the gun 10.

The main housing 18 of the gun 10 has a through bore 20 which is counterbored at successive increments to provide a plurality of internal shoulders 22, 24 and 26 that serve as stops limiting axial movement of the various components of the spray gun.

The spray gun is provided with a spring biased valve member 28 (also shown in FIGS. 2 and 3) that is threadably secured to the end 30 of a valve pull rod 32 which extends coaxially along the through bore 20. The pull rod 32 is supported by a sealing gland 34, and terminates in threaded engagement with an extender sleeve 36. The extender sleeve 36 projects beyond the rear end 38 of the gun housing 18 and threadably receives a collar 40 and a retainer nut 42 which capture the upper end of a trigger, not shown, of the gun.

The valve pull rod 32 also slidably receives a rear spring retainer 44 and the compression spring 46 that is biased against the rear face 48 of the valve member 32, urging the valve member 32 forward against the valve seat 50.

The spray head 12 of the invention, best shown in FIGS. 2 and 3, is removably secured in the forward end of the spray gun housing 18 which has an internally threaded counter-bore 52 for receiving the externally threaded end 54 of the housing 56 of the spray head 12. The housing 56 has a large diameter through passage 58 which is counter-bored at 62 to provide an internal annular shoulder 60. The forward or discharge end 64 of the housing 56 is internally threaded for the removable reception of a retainer nut 66. The housing 56 of the spray head 12 slidably receives the valve member 28, which preferably has a tapered forward end 68 to provide an annular chamber 70 surrounding the valve member 28 and valve seat 50. Although the valve member 28 can be an integral element, it preferably is formed with a valve ball 72 that is received in a friction-fit in a bore 74 centrally located on the forward face of the valve member 28.

The housing 56 of the spray head also slidably receives a plug 76 (FIGS. 1 and 3) or plug 77 (FIGS. 2 and 4) which has an annular groove 78 for receiving a seal member such as the O-ring 80 to seal against the internal wall of the housing 56. The plug has a central through bore 82 which is intersected by two, diverging passageways 83 which are inclined at 30 degrees to the axis of the through bore 82, forming an elongated slot 84 on the forward face (shown best in FIG. 3). The plug also supports a diffuser baffle 86 on a pair of ears 88 which project from its forward face 90. The diffuser baffle 86 extends transversely across the through bore 82 of the plug and is preferably of a triangular cross-section with a knife edge 92 facing the discharge slot 84 of the plug.

Figure 4:
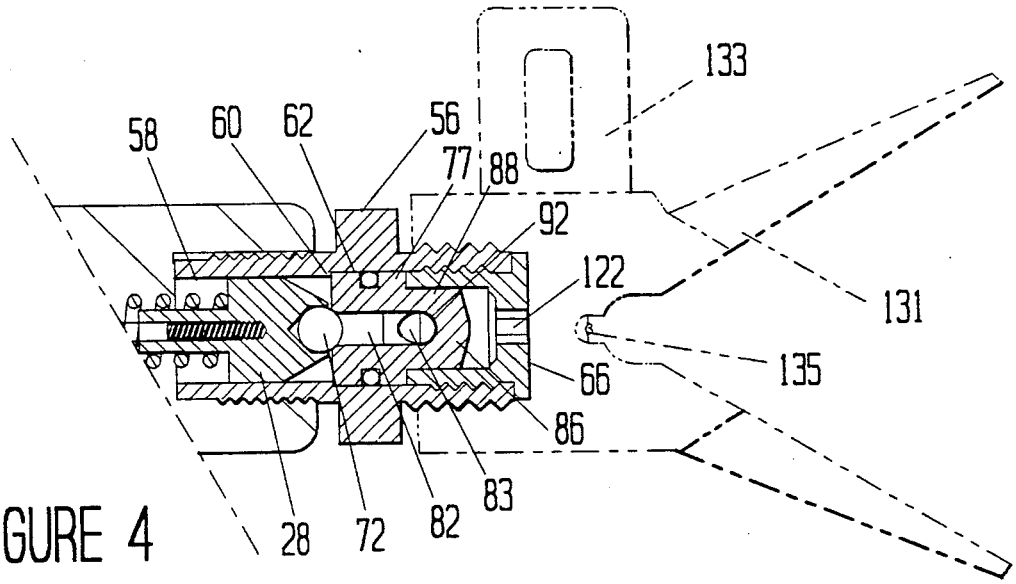
FIG. 4 is an elevational sectional view along line 4—4' of FIGURE and showing an alternative valve seat useful in the invention.

As shown in FIG. 1, the plug 76 can be counter bored at 94 in its upstream face 96 to receive a separate component valve seat 50. Alternatively, and as shown in FIGS. 2 and 4, the plug 77 can have an integrally formed valve seat 51. When the valve seat 50 is a separate component, it is press fitted into the counterbore 94 in plug 76 (FIG. 1). The valve seat, 50 or 51, has a spherical concavity 100 on its upstream face to provide a sealing surface for the valve ball 72 of the valve member 28.

The retainer 66 is a sleeve having an outer annular flange 104 and is, as previously mentioned, threaded on its external surface 106 for removable engagement with the housing 56 of the spray head 12. Preferably, the downstream face 90 of the plug has an annular face 108 to provide a seat for the retainer 66.

As apparent from FIG. 1, the spray head 12 of the invention is readily assembled and disassembled by inserting the plug in the housing 56 and advancing the retainer 66 to seat the peripheral edge of the forward face of the plug against the internal annular shoulder 60 of the housing 56.

The retainer 66 has a large diameter counter bore 110 in its upstream face to receive the diffuser baffle 86 and forward end of the plug. The retainer has a through bore 122 which is broached to provide wrenching flats, e.g. hexagonal flats 112 for wrenching the retainer 66 into and out of engagement with the housing 56.

As illustrated best in FIG. 3, the valve member 28 has a tapered forward end 68 and a bore on its forward end which receives the valve ball 72. The housing 56 has a flange 114 at approximately its mid-point and this flange has wrenching flats, preferably hexagonal flats 116 for application of a wrench. The forward end 118 of the housing 56 is externally threaded for the removable attachment of a spray guard, tip, or other accessory equipment.

In FIG. 3, the plug 76 is shown with the 0-ring 80 (shown in FIG. 1) removed from its annular groove 78. The plug 76 is also shown with the slot 84 on its discharge face in an upright position, orthogonal to the diffuser baffle 86 which is supported on the ears 88 which project from the forward face of the plug. The retainer nut has an end flange 104 and the through bore 122 is hexagonally flatted, all as shown in FIG. 3.

Referring now to FIG. 4, the elements of the spray head 12 of the invention are shown in a sectional view along line 4—4' of FIG. 1. Also shown in this figure is the position of a spray tip and spray guard 131 which is removably threaded on the housing 56 of the spray head. The illustrated spray tip and spray guard is substantially that of prior U.S. Pat. No. 4,715,537, in which a spray tip orifice member 135 is mounted in a turret member having a handle 133 which is rotatably supported in the spray tip housing.

FIG. 4 shows a cross-section of plug 77 which is substantially identical to plug 76 shown in FIGS. 1-3 and illustrates the semicircular concavity of the knife edge 92 of baffle 86 and the divergent passages 83 that extend outwardly at approximately 30 degrees to the through bore 82 of the plug member 56. The plug 77, however, has an integral valve seat 51, rather than a separate component, as shown for plug 76.

Figure 5:
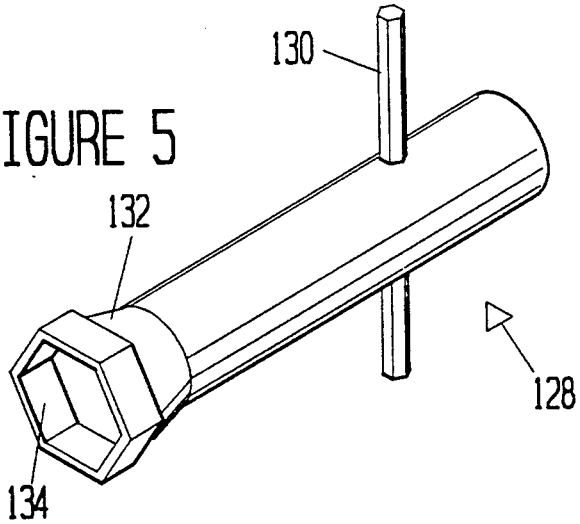
FIG. 5 is a perspective view of an accessory tool for use with the spray head of the invention.

The tool 128 shown in FIG. 5 is used for assembling and disassembling the spray head of the invention. The tool is formed with a tubular body having an enlarged end 132 terminating in a distal hexagonal socket 134 to provide a wrench for removal of the rear retainer nut 42 of the spray gun 10. The tool 128, preferably also has a transversely mounted rod 130, which has a hexagonal cross-section of the appropriate size for fitting into the hexagonally broached through bore 122 of the retainer nut 66, thereby also functioning as a tool for the disassembly of the spray head.

The spray head of the invention provides the advantages of a unitary sub-assembly that includes all of the parts of a spray gun which are subjected to abrasive and erosive conditions during use. Thus the valve seat and the diffuser baffle, which are the two components subjected to the most wear and erosion are formed as a single component, or as a single subassembly, which can be readily removed and replaced by removing the retainer 66 from the housing 56 of the spray head 12. Additionally, the valve member 28 has a tapered or conical forward end 30 which provides an annular chamber 70 surrounding the valve seat 50. This insures that the unavoidable buildup of solid material that accompanies handling and spraying of the highly loaded mastic compositions will not cause frequent clogging of the valve seat and require frequent disassembly for cleaning.

Another advantage of the spray head is that the plug can be readily interchanged with an assortment of plugs having varied through diameters of the through bore and the angular intersecting bore thereby providing a wise latitude of capacity of the spray gun for various widths of sprays as well as adapting to different liquid compositions having varied ranges of solids content.

The plug member is preferably formed in its entirety of a abrasion-resistent material such as tungsten carbide, or other, highly abrasion-resistant material, e.g., chromium base alloys in which chromium is alloyed with other metals such as cobalt. Additionally, the valve member body can also be formed of the same suitably hard and abrasion-resistent material and the valve ball can also be formed of hardened or abrasion-resistant material.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A valve and spray head subassembly for a spray gun having a handle and a moveable valve member coupled to an externally positioned lever actuator, which subassembly comprises:

(a) a tubular housing bearing attachment means for securing the housing in a spray gun, adjacent the moveable valve member therein;

(b) a plug with a central through passageway received and axially restrained within the lumen of said tubular housing;

(c) a valve seat formed of an abrasion-resistant material on the upstream face of said plug and cooperative with said valve member to provide the valve of said gun;

(d) a cross-member also received within the lumen of said tubular housing and located adjacent to and traversing said through passageway of said plug to form a flow diffuser for material discharged through said through passageway, and (e) a single retainer member removably secured onto the discharge end of said tubular housing to secure said plug therein at a preselected axial location;

with said plug, valve seat and cross-member being freely accessible and removable from said spray head assembly upon the removal of said single retainer member.

2. The valve and spray head subassembly of claim 1 wherein said valve seat and said cross member are formed of abrasion-resistant material.

3. The valve and spray head subassembly of claim 2 wherein said abrasion resistant material is tungsten carbide or a chromium base alloy.

4. The valve and spray head subassembly of claim 3 wherein said valve seat and said cross member are formed of tungsten carbide.

5. The valve and spray head subassembly of claim 3 wherein said valve seat and said cross member are formed of chromium-cobalt alloy.

6. The valve and spray head subassembly of claim 2 wherein said cross member is integral with said plug.

7. The valve and spray head subassembly of claim 6 wherein said cross member is supported on a pair of ears axially projecting from downstream face of said plug.

8. The valve and spray head subassembly of claim 1 wherein said through passageway has an outwardly beveled discharge.

9. The valve and spray head subassembly of claim 7 wherein said cross member has a knife edge facing said through passageway.

10. The valve and spray head subassembly of claim 9 wherein said plug is formed of an abrasion-resistant material.

11. The valve and spray head subassembly of claim 10 wherein said abrasion resistant material is tungsten carbide or a chromium base alloy.

12. The valve and spray head subassembly of claim 11 wherein said abrasion resistant material is tungsten carbide.

13. The valve and spray head subassembly of claim 11 wherein said abrasion resistant material is chromium-cobalt alloy.

14. The valve and spray head subassembly of claim 1 wherein said tubular housing is counter-bored to form an internal annular shoulder to serve as an abutment stop for said plug.

15. The valve and spray head subassembly of claim 1 wherein said housing is cylindrical and has external threads on its upstream end for attachment to the internally threaded housing of a spray gun.

16. The valve and spray head subassembly of claim 1 wherein said retainer member is a cup-shaped plug having a center aperture.

17. The valve and spray head subassembly of claim 16 wherein said center aperture in said retainer member is broached with hexagonal flats.

18. The valve and spray head subassembly of claim 1 wherein said retainer member is cylindrical and has external threads for removable attachment to said tubular housing.

19. The valve and spray head subassembly of claim 1 including an annular seal about said plug to engage and seal against the internal wall of said tubular housing.

20. The valve and spray head subassembly of claim 1 wherein said valve member has a conical forward end which seals against said valve seat.

21. The valve and spray head subassembly of claim 1 wherein said valve member bears a spherical tip.

22. The valve and spray head subassembly of claim 1 wherein said valve is surrounded by an annular cavity.

23. In a valve and spray head subassembly for a spray gun having a handle and a moveable valve member having a conical end coupled to an externally positioned lever actuator, which subassembly comprises a tubular housing bearing attachment means for securing the housing in a spray gun, adjacent the moveable valve member therein, the improvement comprising; a single plug with a central through passageway received and axially restrained within the lumen of said tubular housing and carrying:

(1) a valve seat formed of an abrasion-resistant material cooperative to receive the conical end of said valve member and located on the upstream face of said plug; and (2) a diffuser formed with a cross-member also received within the lumen of said tubular housing and located on the downstream end of said plug adjacent to and traversing said through passageway of said plug to form a flow diffuser for material discharged through said through passageway.

24. The valve and spray head subassembly of claim 23 wherein said cross member is integral with said plug.

25. The valve and spray head subassembly of claim 24 wherein said valve seat is integral with said plug.

26. The valve and spray head subassembly of claim 24 wherein said cross member is supported on a pair of ears axially projecting from downstream face of said plug.

27. The valve and spray head subassembly of claim 26 wherein said through passageway has an outwardly beveled discharge.

28. The valve and spray head subassembly of claim 27 wherein said cross member has a knife edge facing said through passageway.

29. The valve and spray head subassembly of claim 24 wherein said plug is formed of an abrasion-resistant material.

30. The valve and spray head subassembly of claim 29 wherein said abrasion resistant material is tungsten carbide or a chromium base alloy.

31. The valve and spray head subassembly of claim 25 wherein said plug is formed of an abrasion-resistant material.

32. The valve and spray head subassembly of claim 31 wherein said abrasion resistant material is tungsten carbide or a chromium base alloy.

* * * * *